US006174105B1

(12) United States Patent
Holmes et al.

(10) Patent No.: US 6,174,105 B1
(45) Date of Patent: Jan. 16, 2001

(54) STRIKE-OFF DEVICE FOR A PAVING SCREED

(76) Inventors: Ted E. Holmes, 1612 N. 19th St., Mattoon, IL (US) 61938-2857; Paul L. Hargis, 9293 E. County Road 1550 N., Humboldt, IL (US) 61931

( * ) Notice: Under 35 U.S.C. 154(b), the term of this patent shall be extended for 0 days.

(21) Appl. No.: 09/363,438

(22) Filed: Jul. 29, 1999

Related U.S. Application Data

(60) Provisional application No. 60/094,928, filed on Jul. 31, 1998.

(51) Int. Cl.[7] ..... E01C 19/00; E01C 19/22
(52) U.S. Cl. ..... 404/104; 404/118
(58) Field of Search ..... 404/96, 118, 119, 404/120, 104

(56) References Cited

U.S. PATENT DOCUMENTS 4,379,653 * 4/1983 Brown ..... 404/118
6,056,474 * 5/2000 Nolan ..... 404/118

* cited by examiner

*Primary Examiner*—Eileen D. Lillis
*Assistant Examiner*—Gary S. Hartmann
(74) *Attorney, Agent, or Firm*—Mark A. Ussai

(57) ABSTRACT

A strike-off device is for a paving screed having a main screed and a screed extension attached to the main screed, the screed extension having a generally vertical front surface. The strike-off device includes a plate disposed frontwardly of and adjacent to the screed extension. The plate has a generally horizontal working edge extending laterally along the front vertical surface of the screed extension. Two connective members extend between the strike-off plate and the screed extension and are configured to adjustably attach the plate to the screed extension, such that vertical displacement of the connective members adjusts a vertical position of the strike-off working edge. Preferably, the connective members are each a threaded rod having a first end engaged with the strike-off plate and a second end engaged with the screed extension, such that rotation of the rods displace the strike-off plate in vertical directions.

18 Claims, 4 Drawing Sheets

STRIKE-OFF DEVICE FOR A PAVING SCREED

This application claims the benefit of U.S. Provisional Application Ser. No. 60/094,928, filed Jul. 31, 1998.

BACKGROUND OF THE INVENTION

The present invention relates to paving machines, and more particularly to strike-off devices for paving screeds.

Screed assemblies 1 used with paving machines to level paving material, typically asphalt, applied by the machine onto a generally horizontal base surface 2 are well known, an example of such being depicted in FIGS. 1 and 2. Such screed assemblies 1 often include both a main screed 3 and one or more pairs of screed extensions 4 connected with the main screed 3. The screed extension 4 may either be fixedly attached (e.g., bolted) to an end of the main screed 3 (or an outer end of another screed extension 4) or movably attached to the main screed 3. Movably attached screed extensions 4 are commonly referred to as "extendible screeds" and are laterally displaceable with respect to the main screed 3, typically by means of hydraulic cylinders (not shown) so as to either be extended outwardly substantially beyond the outer ends 3*b* of the main screed 3 or retracted into centralized positions. Both types of screed extensions 4 enable the screed assembly 1 to be adjusted for use in paving different base surfaces 2 of various widths.

Further, screed assemblies 1 having one or more strike-off devices 5 disposed frontwardly (i.e., with respect to the direction of paving machine travel 11) of the screed sections 3, 4 are also known. Particularly with paving screeds 1 having front-mounted extendible screeds 4, the strike-off devices 5 prevent paving material from accumulating in front of the main screed 3 and thus prevent uneven distribution of paving material across the width of the screed assembly 1. Such known strike-off assemblies 5 typically include a strike-off member or plate 6 movably attached to the main screed 3 such that the vertical position of the plate 6 is adjustable. The strike-off member/plate 6 has a working edge 6*a* at the lower end of the plate 6 which establishes a first height/thickness of paving material prior to leveling by the working surfaces 3*a*, 4*a* of the screed assembly 1. Thus, it is important to control the vertical position of the strike-off working edge 6*a* to ensure that it is at a desired distanced above the working surfaces 3*a*, 4*a* (see FIG. 2) determined to provide optimal performance of the paving screed assembly 1.

Further, in order to control the depth of the finished "mat" of paving material, the "angle of attack" $\alpha$ of the screed assembly 1 (FIG. 2) may often have to be adjusted. First, the main screed 3 is "tilted" frontwardly or rearwardly to position the main screed working surface 3*a* at the desired angle $\alpha$. As the strike-off plate 6 and screed extensions 4 are attached to the main screed 3, varying the angle a of the main screed 3 causes both the screed extensions 4 and the strike-off plate 6 to move vertically upwardly or downwardly. Thus, the screed extension 4 must first be adjusted vertically to the proper height, which in the known assembly 1 of FIGS. 1 and 2, requires moving two cylindrical posts 8 at the upper end of each screed extension 4 within an associated bushing 9 extending through a support member 7, a pair of the support members 7 connecting each screed extension 4 to the main screed 3. Therefore, four separate adjustments may be required to properly position the two extensions 4, although preferably a vertical positioning device 15 is configured to simultaneously adjust the pair of posts 8 for each screed extension 4 so that the operator need only make two adjustments (i.e., one for each extension 4).

Further, the strike-off plate 6 must also be adjusted to position the strike-off working edge 6*a* at the proper height, which with the two devices 5 depicted in FIGS. 1 and 2, requires adjusting two pairs of threaded rods 5*a* which connect each plate 6 to the main screed 3 (specifically to a separate support member 7). Therefore, properly positioning the strike-off device 5 requires another four separate adjustment steps. Thus, whenever the angle of attack a of the main screed 3 is adjusted, at least six and potentially eight separate adjustment steps may be required to position both the screed extensions 4 and the strike-off plate 6 of the known strike-off device 5 at proper working heights.

Therefore, it is desirable to provide a strike-off device for a screed assembly in which the number of adjustment steps required to properly position both the screed extensions and the strike-off plates after a change in the angle of attack a is less than that required for previously known strike-off devices.

SUMMARY OF THE INVENTION

In one aspect, the present invention is a strike-off device for a screed assembly for leveling paving material upon a generally horizontal base surface. The screed assembly includes a main screed and a screed extension attached to the main screed, the screed extension having a generally vertical front surface and a generally horizontal working surface. The strike-off device comprises a strike-off member disposed frontwardly of and adjustably connected with the screed extension. The member has a generally horizontal working edge extending laterally along the front vertical surface of the screed extension. Further, the strike-off member is displaceable vertically with respect to the base surface so as to adjust a vertical position of the working is edge with respect to the screed extension working surface.

In another aspect, the present invention is a strike-off device for a paving screed having a main screed and a screed extension attached to the main screed. The screed extension having a generally vertical front surface. The strike-off device comprises a strike-off plate disposed frontwardly of and adjacent to the screed extension. The plate has a generally horizontal working edge extending laterally along the front vertical surface of the screed extension. A connective member extends between the strike-off plate and the screed extension and is configured to movably attach the plate to the screed extension.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
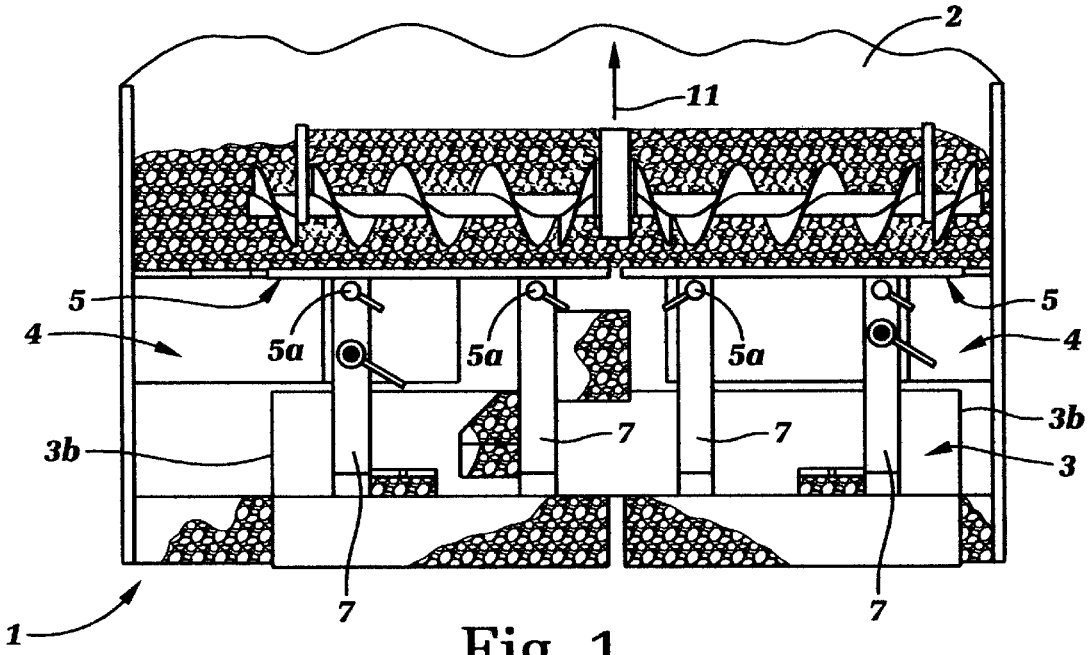
Fig. 1 (Prior Art)
FIG. 1 is a top elevational view of a typical screed assembly having a known strike-off device.

Certain terminology is used in the following description for convenience only and is not limiting. The words "right", "left", "lower", "upper", "upward", "down" and "downward" designate directions in the drawings to which reference is made. The words "front", "frontward" and "rear", "rearward" refer to directions toward and away from, respectively, a designated front section of a screed assembly, a strike-off device or a specific portion of either, the particular meaning intended being readily apparent from the context of the description. The terminology includes the words specifically mentioned above, derivatives thereof, and words of similar import.

Referring now to the drawings in detail, wherein like numbers are used to indicate like elements throughout, there is shown in FIGS. 3–6 a strike-off device 10 in accordance with the present invention for use with a screed assembly 1 for leveling paving material upon a generally horizontal base surface 2. The screed assembly 1 preferably includes at least a main screed 3 and a screed extension 4 attached to the main screed 3, the screed extension 4 having a generally vertical front surface 4*b* and a generally horizontal working surface 4*a*.

The strike-off device 10 basically comprises a strike-off member 12 disposed frontwardly of and adjustably connected with the screed extension 4. The strike-off member 12 has a generally horizontal working edge 13 extending laterally along the front vertical surface 4*b* of the screed extension 4. Further, the strike-off member 12 is displaceable vertically with respect to the base surface 2 so as to adjust a vertical position of the working edge 13 with respect to the screed extension working surface 4*a*. More specifically, a connective member 14 extends between and connects the strike-off member 12 and the screed extension 4 and is movable in vertical directions so as to displace the strike-off member 12 vertically with respect to the base surface 2. Each of the above-recited elements of the strike-off device 10 is described in further detail below.

Figure 3:
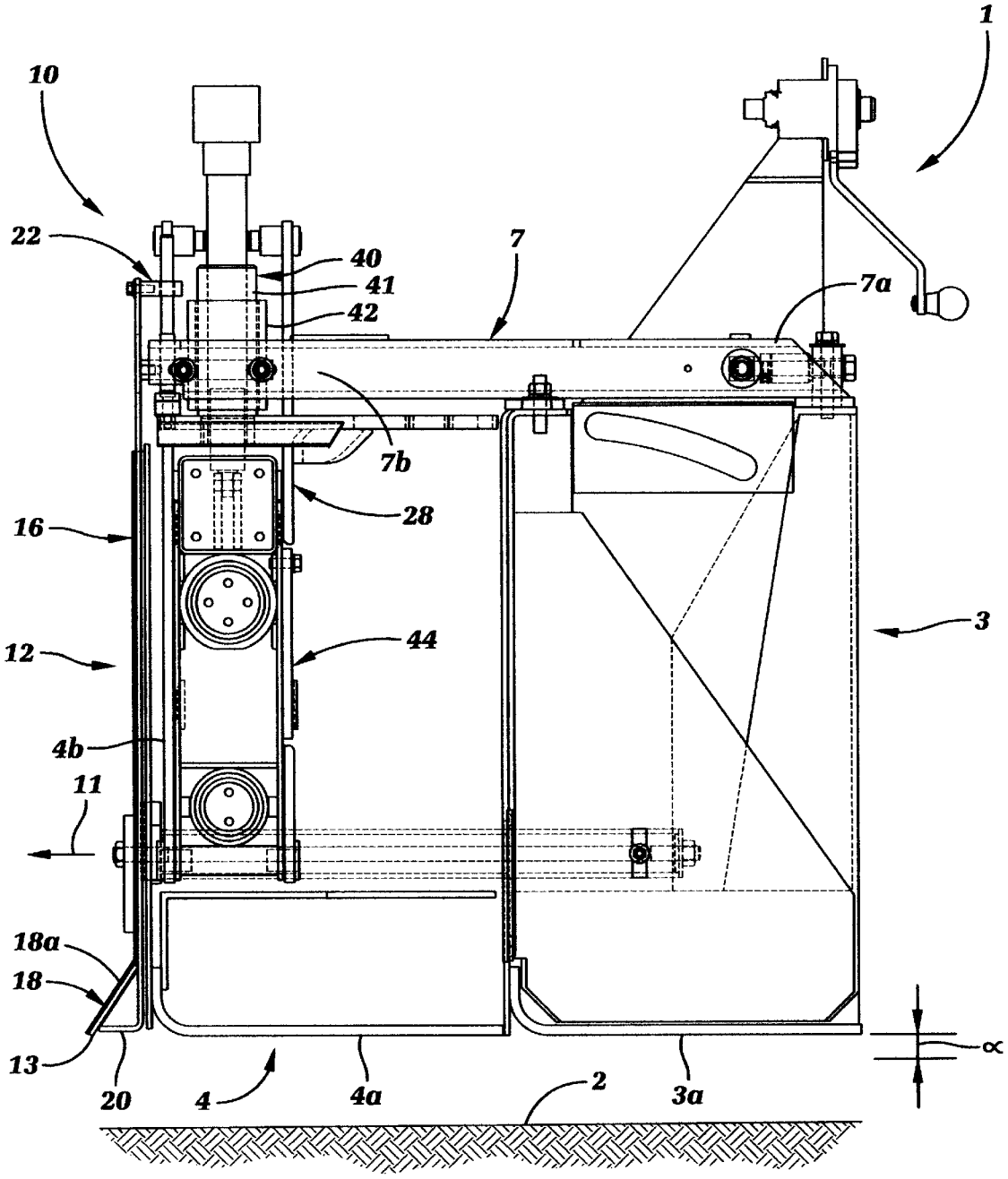
FIG. 3 is a side plan view of a screed assembly having a strike-off device in accordance with the present invention, showing a left-hand screed extension.

Referring to FIGS. 1 and 3, the strike-off device 10 is preferably used with a screed assembly 1 constructed generally similarly to known screed assemblies 1 as discussed in the Background section of the present disclosure. The screed assembly 1 thus preferably includes two screed extensions 4 attached to the main screed 3, each screed extension 4 being laterally displaceable along the front surface 3*c* of the main screed 3 in the manner of front-mounted "extendible screeds". However, the strike-off device 10 may also be used with a screed assembly 1 having screed extensions 4 fixedly attached ("bolt-on") to the main screed 3.

Further, as the preferred screed assembly 1 includes two screed extensions 4 as described above, the screed assembly 1 preferably has two separate strike-off devices 10 of the present invention. In other words, a left—hand strike-off device 10 (FIGS. 3 and 4) and a right-hand strike-off device 10 (FIG. 5) are each connected with the respective left and right hand screed extensions 4. As the left-hand and right-hand devices 10 are generally identical to each other, the left-hand strike-off device 10 (for use with the left-hand screed extension 4) is primarily depicted and described in detail herein in order to clarify the description of the present invention.

Referring again to FIGS. 3–6, the strike-off member 12 is preferably configured as a generally flat and generally rectangular plate 16, as best shown in FIG. 6. The plate 16 preferably includes a blade member 18 located near the lower portion of the plate 16 and which extends generally laterally across the width of the plate 16. The blade member 18 provides the working edge 13 of the strike-off device 10 at the lower end of the member 18. The blade member 18 is preferably a generally flat, narrow rectangular plate that is attached to the strike-off plate 16 by appropriate means, such as welding, and is preferably angled frontwardly so as to provide a carrying surface 18*a* for moving or shoveling paving material as the screed assembly 1 moves forwardly during a paving operation.

Further, as shown in FIG. 3, the strike-off plate 16 preferably includes a support ledge 20 extending frontwardly from the lower portion of the plate 16, which provides support for the blade member 18 to prevent the member 18 from being bended rearwardly by the mass of the paving material. Although it is preferred to construct the strike-off plate 16 with a blade member 18 and a support ledge 20, it is within the scope of the present invention to configure the plate 16 with a generally straight, vertically extending lower section (not shown) such that the working edge 13 is provided by the lower edge of the plate 16 itself.

Figure 4:
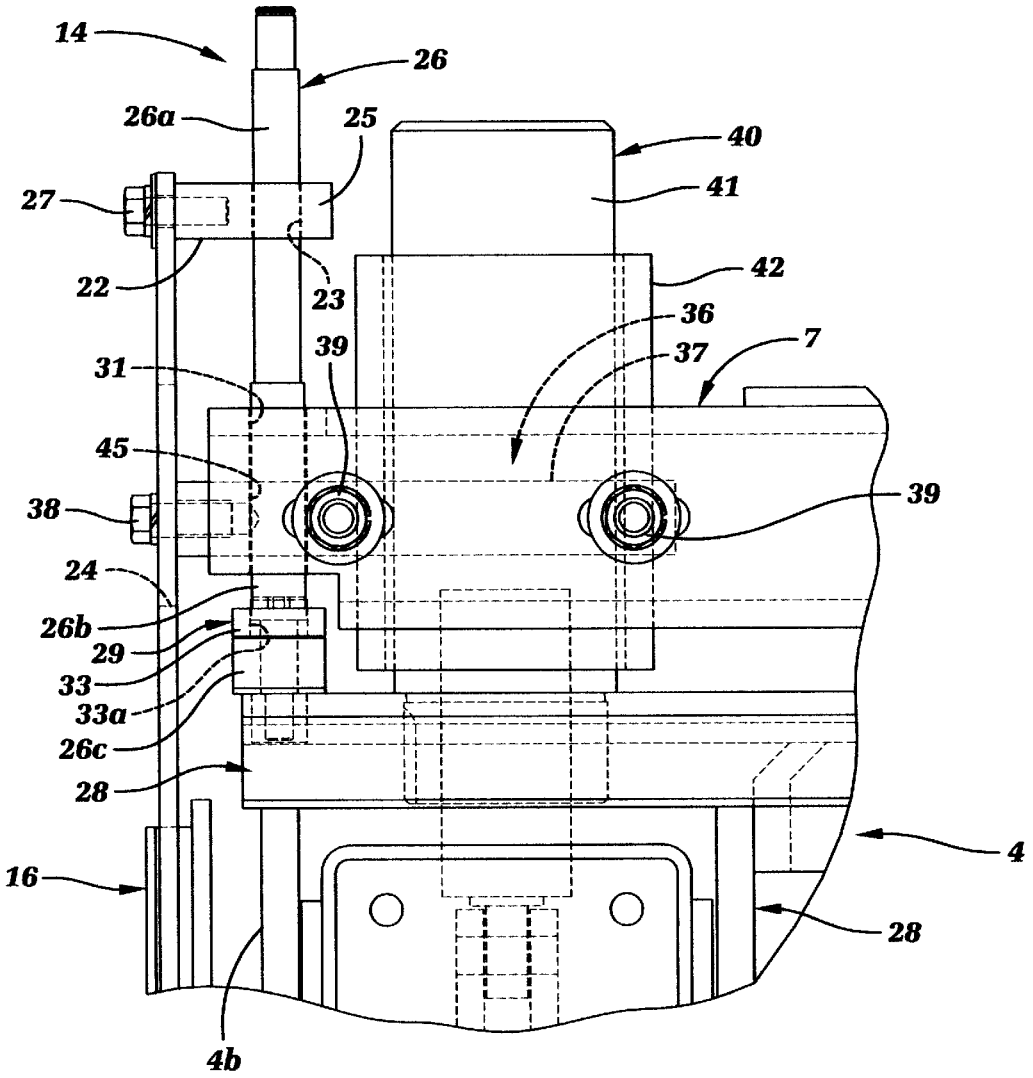
FIG. 4 is a greatly enlarged, broken-away side plan view of a portion of the strike-off assembly shown in FIG. 3, shown with certain components of the screed extension removed.
Figure 5:
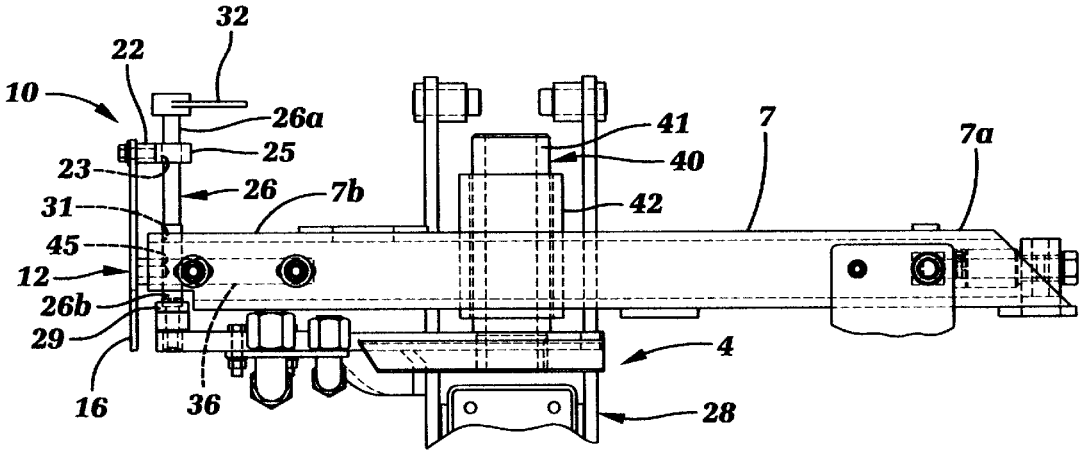
FIG. 5 is enlarged, broken-away side plan view of the screed assembly, showing portions of a right-hand screed extension and portions of a right-hand strike-off device.
Figure 6:
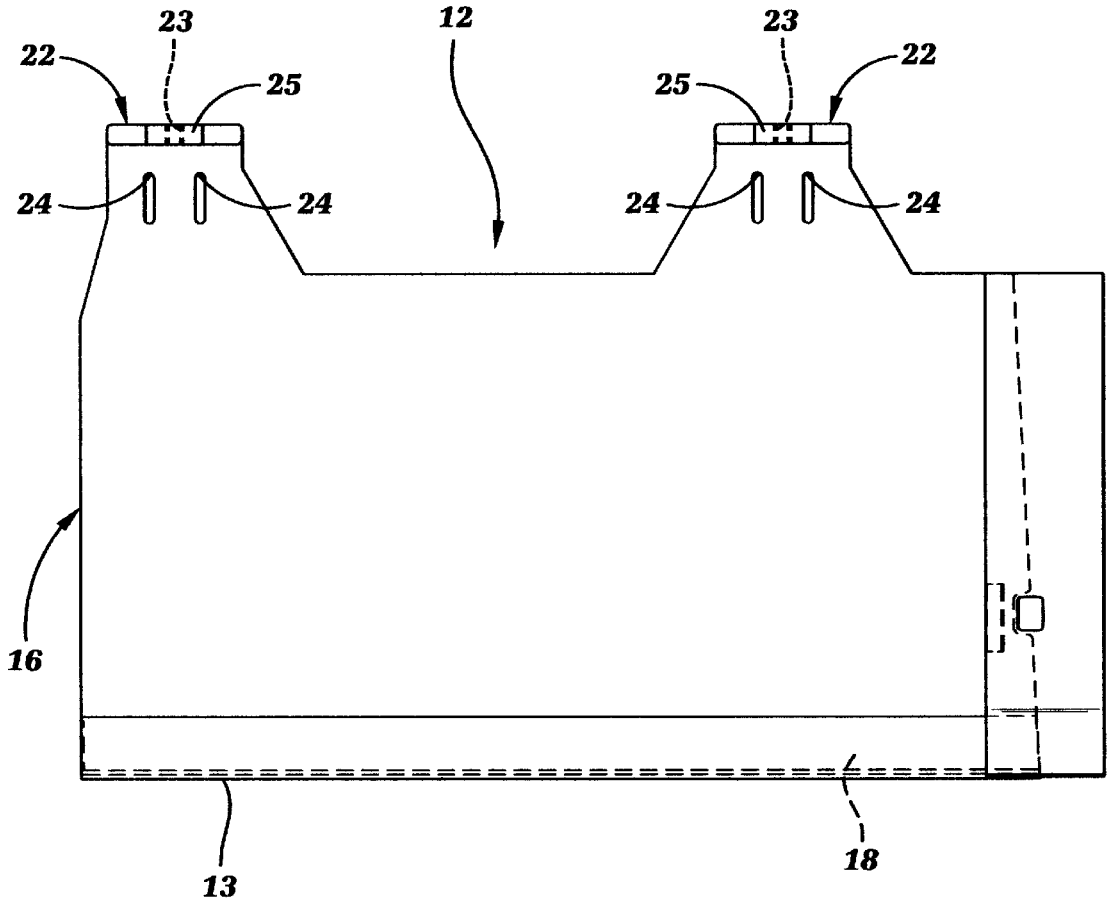
FIG. 6 is rear plan view of a strike-off plate for a left-hand strike-off device.

Still referring to FIGS. 3–6, the plate 16 preferably further includes at least one and preferably two engagement member 22 extending rearwardly from the upper end the plate 16. Each engagement member 22 is configured for engaging with a separate connective member 14, as discussed in further detail below. The engagement members 22 are each preferably constructed as a bar having a projecting lug section 25 and are each attached to the plate 16 by threaded fasteners 27. Alternatively, the engagement portions 22 may be attached to the strike-off plate 16 by other means, such as for example by welding, or may integrally formed with the plate 16. Each engagement member 22 includes a threaded hole 23 configured for engaging with an associated connective member 14 as described in further detail below. Further, as shown in FIG. 6, the plate 16 preferably also includes two pairs of parallel, vertically-extending slots 24, the purpose of which is discussed below.

Although it is preferred to construct the strike-off member 12 as a plate 16 as described above, it is within the scope of the present invention to construct the strike-off member 12 in any other appropriate configuration. For example, the member 12 may alternatively be constructed of a lower blade or bar portion providing the working edge 13 and an upper frame portion configured to carry the blade or bar and to connect with the screed extension 4 (structure not shown). The present invention embraces all appropriate constructions of the strike-off member 12 that enable the strike-off device 10 to function as described in the present disclosure.

Referring to FIGS. 3–5, each strike-off device 10 of the present invention includes at least one and preferably two connective members 14 (only one shown in each drawing figure), the two connective members 14 being spaced horizontally and laterally with respect to the screed extension 4. By having two connective members 14, adjustment of a vertical position of one connective member 14 with respect to the other connective member 14 adjusts an angular position of the strike-off member working edge 13 with respect to the base surface 2. In other words, when the two connective members 14 are at substantially the same vertical position, the working edge 13 is substantially parallel with the base surface 2, such that the working edge 13 is essentially parallel with the base surface 2. When one connective member 14 is adjusted vertically with respect to the other member 14, the difference in relative vertical positions causes the connected strike-off plate 16 to be angled or tilted laterally, such that there is an angle between the edge 13 and the base surface 2 that is greater than 0°. However, with the below-described structure of the connective members 14, the amount of lateral tilting of the plates 16 is limited to relatively small angular values.

Although two connective members 14 are preferred, the strike-off device 10 of the present invention is capable of functioning with only a single connective member 14 or three or more connective members 14 (neither configuration depicted). However, two connective members 14 are generally preferred as a device 10 with a single member 14 is less rigid or stable and is incapable of controlled lateral tilting, whereas a device 10 with three or more members 14 would require an excessive amount of adjusting (i.e., of the connective members 14) to position the strike-off working edge 13 at a desired height or vertical position.

Still referring to FIGS. 3–5, each connective member 14 is preferably generally identically constructed and is configured as a rod 26 having a first end 26*a* engaged with the strike-off member 16 and a second end 26*b* engaged with the screed extension 4. Preferably, the first, upper end 26*a* has an exterior threaded portion (threads not shown) that is threadably engaged with the strike-off member 16, although the second, lower end 26*b* may alternatively be threadably engaged with the screed extension 4, as discussed below. The rod 26 is rotatable alternately in opposing directions so as to displace the strike-off member 12 alternately in opposing vertical directions. In other words, rotating the rod 26 in a first direction (e.g. clockwise) displaces the strike-off member 16 vertically in an upward direction and rotating the rod 26 in a second, opposing direction (i.e., counter-clockwise) displaces the strike-off member 16 vertically in a downward direction.

Preferably, the rod 26 is threaded substantially along its entire length and is configured as a jackscrew or "power" screw (i.e., configured to transmit power and/or motion). The first, upper end 26*a* of each rod 26 extends through the threaded hole 23 of an associated engagement member 22 of the strike-off plate 16. The second, lower end 26*b* of each rod 26 is preferably secured within a bushing 29 attached to a saddle assembly 28 of the screed extension 4, such that the rod 26 is capable of rotating within the bushing 29 but is prevented from displacing (i.e., vertically) with respect to the screed extension 4.

Referring specifically to FIG. 4, each rod 26 preferably has an enlarged-diameter portion 26*c* proximal to the second end 26*b* thereof and the bushing 29 is preferably provided by a through-hole 33*a* in a rectangular plate 33 attached to the saddle assembly 28 by threaded fasteners (not shown). With this structure, the enlarged-diameter portion 26*c* of the rod 26 is "sandwiched" between the plate 33 and the upper surface of the saddle assembly 28 such that the connective member 14 is prevented from displacing vertically. Further, each connective member 14 preferably includes a handle 32 (FIG. 5) attached to the upper end 26*a* of the rod 26 and configured to enable manual rotation of the rod 26 (i.e., within bushing 29). However, the strike-off device 10 may be provided with alternative means for rotating the rods 26, such as for example, with a chain-and-sprocket assembly (not shown) that may be driven manually and/or automatically.

Preferably, the pair of rods 26 for each strike-off device 10 are engaged with the screed extension 4 at locations selected such that each rod 26 extends through a clearance hole 31 in a proximal support member 7 of the main screed 3. As a detailed description of the screed extensions 4 and the main screed 3 is beyond the scope of the present disclosure, it is sufficient to note here that each screed extension 4 includes one of the above-mentioned saddle assemblies 28, with each saddle assembly 28 being movably connected to a pair of tubular support members 7 so as to connect the screed extension 4 with the main screed 3 (see FIG. 1), as discussed in more detail below. By locating the rods 26 so that each extends through a support member 7, the rods 26 are provided with lateral support (i.e., by the upper walls of the associated support member 7) so as to prevent the rods 26 from becoming bended. However, the rods 26 may alternatively be engaged with the screed extension 4 at any other appropriate location on the extension 4 and the connective members 14 will function as intended whether or not the members 14 extend through the support members 7.

With the above-described preferred structure, rotation of the rod 26 causes the associated engagement member 22 to travel along the thread(s) of the rod 26 so as to move vertically in either an upward or downward direction. The strike-off plate 16 thereby moves with the attached engagement members/lugs 22 to also displace vertically with respect to the screed extension 4, and thus also with respect to the main screed 3 and the base surface 2. Alternatively, the engagement members 22 may be fixedly attached to the associated rod 26 and the lower end 26*a* of each rod 26 may be threadably engaged with, and vertically movable with respect to, the associated bushing 29 on the screed extension saddle 28. With such an alternative configuration, rotation of a rod 26 vertically displaces the rod 26, the associated engagement member 22 and the strike-off plate 16 with respect to the screed extension 4.

Although the connective members 14 are preferably jackscrew or power screw rods 26 threadably engaged with the strike-off member 12 as described above, the connective members 14 may alternatively be constructed in any other appropriate manner that enables the connective members 14 to movably or adjustably attach the strike-off plate 16 to the screed extension 4. For example, each connective member 14 may be a hydraulic "stab" cylinder, a telescoping rod, a rack-and-pinion assembly, or any other mechanical device or assembly having at least two movably connected portions, with one portion being attached to the plate 16 and the other portion being attached to the screed extension 4 (none shown). Therefore, the present invention embraces the above-described structures of the connective members 14 and other known structures that enable the strike-off device to function substantially as described in the present disclosure.

Referring now to FIGS. 3–5, the strike-off device 10 preferably includes two retainers 36 each connected with the strike-off plate 16 and with the main screed 3. Each retainer 36 preferably includes a bar 37 disposed within a separate one of the tubular support members 7 of the main screed 3 and is fixedly secured within the member 7 by fasteners 39. Referring specifically to FIG. 4, a pair of headed rods or studs 38 (only one shown) extend frontwardly from each bar 37 and through a proximal pair of parallel slots 24 in the plate 16, such that the plate 16 is disposed between the headed portions of the rods 38 and the retainer bars 37. Further, each bar 37 includes a clearance hole 45, through which extends a portion of the connective member rod 26, SO that the retainers 36 do not interfere with the desired positioning of the connective members 14.

By having the slots 24 and retainers 36, the strike-off plate 16 is capable of moving vertically with respect to the main screed 3 in order to move with the screed extension 4 when the screed 4 displaces vertically with respect to the main screed 3. However, the retainers 36 prevent the plate 16 from moving horizontally, either laterally or frontwardly, with respect to the screed assembly 1 in order to prevent damage to components of the strike-off device 10, particularly the rods 26, that may occur by such movement of the plate 16. Although it is preferred to construct the strike-off device 10 to include the retainers 36 for the reasons discussed above, the strike-off device 10 of the present invention is capable of functioning as intended (as described herein) without any such retainers 36. Therefore, the scope of the present invention embraces both strike-off devices 10 including retainers 36 and strike-off devices 10 constructed without any retainers 36 or equivalent devices.

Still referring to FIGS. 3–5, as mentioned above, the screed extensions 4 are each vertically adjustable with respect to the main screed 3. Since each strike-off device 10 is attached to a (separate) screed extension 4, vertical displacement of the screed extension 4 with respect to the main screed 3 adjusts a vertical position of the strike-off member 12 with respect to the main screed 3. Preferably, the main screed 3 includes two pairs of the above-mentioned tubular support members 7 (only one depicted in FIGS. 3–5), with each support member 7 having a first end 7*a* attached to the main screed 3 and a second end 7*b*. Each screed extension 4 is adjustably attached to the second ends 7*b* of one pair of support members 7 so as to be displaceable vertically with respect to the main screed 4.

Figure 2:
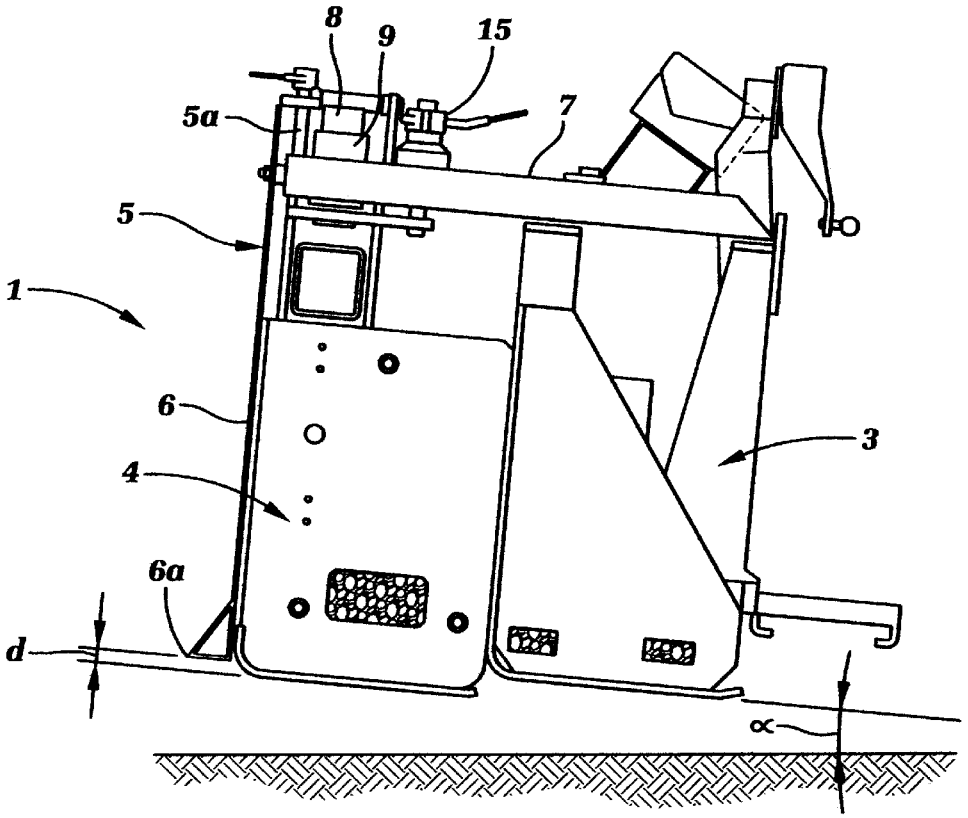
Fig. 2 (Prior Art)
FIG. 2 is a side elevational view of the screed assembly of FIG. 1.

More specifically, the saddle assembly 28 of each screed extension 4 includes one portion 40 adjustably attached to one support member 7 and another portion (not depicted) adjustably attached to the other support member 7. Preferably, the portions 40 are provided by two generally vertical posts 41 (only one shown) extending upwardly from an upper end of the saddle assembly 28. Each post 41 extends through a separate bushing 42 mounted in each support member 7 and is movable therein by means of an adjustment device (not depicted), similar to the vertical positioning device 15 described in the Background section herein and shown in FIG. 2, such that both posts 41 of each screed extension 4 are simultaneously vertically adjusted.

Therefore, when the screed extension 4 is displaced vertically by adjusting or sliding the posts 41 with the associated bushings 42, the strike-off plate 16 also displaces vertically the same distance as the extension 4. More specifically, when the screed extension 4 moves with respect to the connected pair of support members 7 (and thus with respect to the main screed 3), the attached connective members 14 each slide through the clearance holes 31, 45 in the associated support member 7 and retainer 36, respectively, and the retainer studs 38 slide within the associated vertical slots 24 in the strike-off plate 16, as the connective members 14 carry the connected strike-off member 12 so as to move vertically therewith.

Referring specifically to FIG. 3, the strike-off device 10 of the present invention is most preferably used with screed extensions 4 having a first portion, the saddle assembly 28, that is connected with and vertically adjustable with respect to the main screed 3 (as described above) and a second portion, a slidable frame 44, that is connected with and horizontally displaceable with respect to the first, saddle portion 28. As the strike-off device 10 is attached to the saddle assembly 28, the strike-off plate 16 displaces only vertically with the screed extension 4 and does not displace laterally. In other words, when the slidable frame 44 (which carries the screed extension working surface 4*a*) is located in an extended position beyond the ends 3*a* of the main screed 3, the strike-off plate 16 remains disposed frontwardly of the main screed 3. Thus, the strike-off plate 16 "strikes-off" paving material disposed in front of the main screed 3 and thereby prevents paving material from accumulating on the front surface of the main screed 3, which would result in uneven leveling of the paving material by the screed assembly 1.

Prior to use, the strike-off device 10 is adjusted to position the strike-off working edge 13 at a desired vertical position with respect to the screed working surfaces 3*a*, 4*a* (such as spaced upwardly by a distance d as shown in FIG. 1) by adjusting the connective members 14, as described above. During a paving operation, a paving machine or paver (not shown) pulls the screed assembly 1 forwardly in the direction of paving as the paver deposits material onto the base surface 2, the material being then distributed across the width of the screed assembly 1 by means of an auger (not shown). The working edge 13 of the strike-off plate 16 contacts the "head" of paving material and pushes or shovels an upper portion of the material forwardly, leaving a lower portion of material on the base surface 2 that has generally a desired height or thickness for leveling by the screed working surfaces 3*a*, 4*a*.

Whenever the operator determines that the angle of attack a of the screed assembly 1 should be adjusted (i.e., to change the thickness of the mat of material), the main screed 3 is first "tilted" either frontwardly or rearwardly to position the main screed working surface 3*a* at the desired angle of attack $\alpha$. As the screed extensions 4 are each connected with the main screed 3, the working surfaces 4*a* of the screed extensions 4 are positioned at the desired angle $\alpha$ by the adjustment of the main screed 3. However, as discussed in the Background section, the vertical position of the screed extensions 4 must be adjusted to position the screed extension working surfaces 4*a* at about the same height as the main screed working surface 3*a*.

Therefore, the vertical position of each screed extension 4 is adjusted by moving the saddle posts 41 within the bushings 42 (as described above), which requires two adjustment operations or steps with the preferred screed assembly having adjustment devices (not shown) to simultaneously adjust each pair of posts 41 as described above. As the strike-off devices 10 are each attached to an screed extension 4, the strike-off working edge 13 is automatically positioned at an appropriate vertical position with respect to the screed working surfaces 3*a*, 4*a* by the adjustment of the screed extensions 4. Thus, after the initial adjustment of each strike-off device 10 to establish the desired position of the working edge 13 with respect to screed working surfaces 3*a*, 4*a*, no further adjustment of the strike-off devices 10 themselves is generally required during the paving operation.

It is apparent that the strike-off device 10 of the present invention is advantageous when compared to previously known strike-off devices, such as the strike-off 6 described in the Background section. Primarily, the strike-off device 10 of the present invention eliminates the need to adjust the height of the strike-off working edge 13 when the screed assembly angle of attack a is being changed. Thus, when using the strike-off device 10 with a screed assembly 1 as described above, the number of required adjustment steps is only two compared with the at least six (and possibly eight) adjustments required when using the previously known strike-off device 6, with a corresponding reduction in the amount of time that the paving process must be halted or delayed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A strike-off device for a screed assembly for leveling paving material upon a generally horizontal base surface, the screed assembly including a main screed having a generally horizontal working surface and a screed extension adjustable attached to the main screed so as to be displaceable vertically with respect to the base surface, the screed extension having a generally vertical front surface and a generally horizontal working surface, the strike-off device comprising:

a strike-off member disposed frontwardly of and adjustably attached to the screed extension, having a generally horizontal working edge extending laterally along the front vertical surface of the screed extension, and displaceable vertically with respect to the base surface so as to adjust a vertical position of the working edge with respect to the screed extension working surface;

wherein adjustment of the vertical position of the screed extension with respect to the main screed adjusts a vertical position of the strike-off working edge with respect to the main screed working surface.

2. The strike-off device as recited in claim 1 further comprising a connective member extending between and connecting the strike-off member and the screed extension and movable in vertical directions so as to displace the strike-off member vertically with respect to the base surface.

3. The strike-off device as recited in claim 2 wherein the connective member is a rod having a first end engaged with the strike-off member and a second end engaged with the screed extension, at least one of the first end being threadably engaged with the strike-off member and the second end being threadably engaged with the screed extension, the rod being rotatable alternately in opposing directions so as to displace the strike-off member alternately in opposing vertical directions.

4. The strike-off device as recited in claim 2 further comprising another connective member, the two connective members being spaced horizontally on the screed extension such that adjustment of a vertical position of one connective member with respect to the other connective member adjusts an angular position of the strike-off member working edge with respect to the base surface.

5. The strike-off device as recited in claim 1 wherein the screed extension includes:

a first portion connected with and vertically adjustable with respect to the main screed; and a second portion connected with and horizontally displaceable with respect to the first portion, the strike-off member being attached to the first portion of the screed extension.

6. The strike-off device as recited in claim 1 wherein the strike-off member is configured as a plate.

7. The strike-off device as recited in claim 1 wherein the main screed includes a support member having a first portion attached to the main screed and a second portion, the screed extension being adjustably attached to the second portion of the support member so as to be displaceable vertically with respect to the main screed.

8. The strike-off device as recited in claim 7 wherein vertical displacement of the screed extension with respect to the main screed adjusts a vertical position of the strike-off member with respect to the main screed.

9. A strike-off device for a paving screed having a main screed and a screed extension attached to the main screed, the screed extension having a generally vertical front surface, the strike-off device comprising:

a strike-off plate disposed frontwardly of and adjacent to the screed extension and having a generally horizontal working edge extending laterally along the front vertical surface of the screed extension; and a connective member extending between the strike-off plate and the screed extension, attached directly to the screed extension and configured to movably attach the plate to the screed extension.

10. The strike-off device as recited in claim 9 wherein the connective member is displaceable vertically with respect to the base surface so as to adjust a vertical position of the strike-off working edge with respect to the screed extension working surface.

11. The strike-off device as recited in claim 9 wherein:

the main screed has a generally horizontal working surface; and the screed extension is adjustably attached to the main screed so as to be displaceable vertically with respect to the base surface such that adjustment of the vertical position of the screed extension with respect to the main screed adjusts a vertical position of the strike-off working edge with respect to the main screed working surface.

12. The strike-off device as recited in claim 9 wherein the screed extension includes:

a first portion connected with and vertically adjustable with respect to the main screed; and a second portion connected with and horizontally displaceable with respect to the first portion, the strike-off plate being attached to the first portion of the screed extension.

13. The strike-off device as recited in claim 9 wherein the connective member is a rod having a first end engaged with the strike-off plate and a second end engaged with the screed extension, at least one of the first end being threadably engaged with the strike-off plate and the second end being threadably engaged with the screed extension, the rod being rotatable alternately in opposing directions so as to displace the strike-off plate alternately in opposing vertical directions.

14. The strike-off device as recited in claim 9 further comprising another connective member, the two connective members being spaced horizontally on the screed extension such that adjustment of a vertical position of one connective member with respect to the other connective member adjusts an angular position of the strike-off plate working edge with respect to the base surface.

15. The strike-off device as recited in claim 14 wherein vertical displacement of the screed extension with respect to the main screed adjusts a vertical position of the strike-off plate with respect to the main screed.

16. The strike-off device as recited in claim 9 wherein the main screed includes a support member having a first portion attached to the main screed and a second portion, the screed extension being adjustably attached to the second portion of the support member so as to be displaceable vertically with respect to the main screed.

17. A strike-off device for a screed assembly for leveling paving material upon a generally horizontal base surface, the screed assembly including a main screed and a screed extension attached to the main screed, the main screed including a support member having a first portion attached to the main screed and a second portion, the screed extension being adjustably attached to the second portion of the support member so as to be displaceable vertically with respect to the main screed, the screed extension having a generally vertical front surface and a generally horizontal working surface, the strike-off device comprising:

a strike-off member disposed frontwardly of and adjustably attached to the screed extension, having a generally horizontal working edge extending laterally along the front vertical surface of the screed extension, and displaceable vertically with respect to the base surface so as to adjust a vertical position of the working edge with respect to the screed extension working surface.

18. The strike-off device as recited in claim 17 wherein vertical displacement of the screed extension with respect to the main screed adjusts a vertical position of the strike-off member with respect to the main screed.

* * * * *

UNITED STATES PATENT AND TRADEMARK OFFICE

CERTIFICATE OF CORRECTION

PATENT NO. : 6,174,105 B1
DATED : January 16, 2001
INVENTOR(S) : Ted E. Holmes and Paul L. Hargis It is certified that error appears in the above-identified patent and that said Letters Patent is hereby corrected as shown below:

Column 9, claim 1,
Line 20, delete "adjustable" and insert -- adjustably --.

Signed and Sealed this

Twenty-ninth Day of January, 2002

*Attest:*

*Attesting Officer*

JAMES E. ROGAN
*Director of the United States Patent and Trademark Office*